US007055728B2

(12) United States Patent
Lin

(10) Patent No.: US 7,055,728 B2
(45) Date of Patent: Jun. 6, 2006

(54) POSITIONING STRUCTURE FOR NAILER

(75) Inventor: Rick Lin, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/978,061

(22) Filed: Oct. 28, 2004

(65) Prior Publication Data

US 2006/0091178 A1 May 4, 2006

(51) Int. Cl.
*B25C 5/02* (2006.01)

(52) U.S. Cl. ..... 227/110; 227/120; 227/140

(58) Field of Classification Search ..... 227/120, 227/110, 140, 111, 15, 150
See application file for complete search history.

(56) References Cited

U.S. PATENT DOCUMENTS 5,054,678 A * 10/1991 Nasiatka ..... 227/8
5,165,827 A * 11/1992 Miller ..... 408/16
5,261,588 A * 11/1993 Lin ..... 227/110
5,628,445 A * 5/1997 Braddock et al. ..... 227/151
5,743,455 A * 4/1998 Holliday ..... 227/142
6,161,744 A * 12/2000 Mukoyama et al. ..... 227/8
6,824,036 B1 * 11/2004 Walter ..... 227/120
6,843,402 B1 * 1/2005 Sims et al. ..... 227/148

* cited by examiner

*Primary Examiner*—Scott A. Smith
*Assistant Examiner*—Brian Nash
(74) *Attorney, Agent, or Firm*—Charles E. Baxley

(57) ABSTRACT

The present invention relates to a positioning structure for a nailer capable of adjusting the position of the nailer arbitrarily. In the rail of magazine is slidably provided an adjusting member whose lateral side is disposed an engaging paw against which a spring abuts. The engaging paw is formed in response to the shape of the cavities in the sidewall of the groove of the rail. On a side of the engaging paw opposite the spring is disposed a press key which partially projects out of the adjusting member and is provided for being pressed by the user. This adjusting member can enable the user to adjust the position of the nailer arbitrarily. The position structure can make the operation easy for the user and can be prevented from being mistakenly pressed by the user.

6 Claims, 4 Drawing Sheets

POSITIONING STRUCTURE FOR NAILER

BACKGROUND OF THE INVENTION

1. Field of the Invention

The present invention relates to a nailer, and more particularly to a positioning structure for a nailer having an adjusting member which is designed to enable the user to adjust the position of the nailer arbitrarily, and the adjusting member has an engaging paw and a press key which are laterally disposed for make the operation easy for the user.

2. Description of the Prior Arts

Nowadays, nailers have been widely used in different trades. However, only a skilled user can eject the nail precisely into an object to be nailed, that means the nailing accuracy of the conventional nailers replies on the experience of the user. An unskilled user hardly can make the nail eject into an object precisely, and due to the heavy weight, the nailer is likely to sway during the nailing course, the nail is likely to deviate from the nailing position. Thereby, the conventional nailer is difficult to be controlled.

The present invention has arisen to mitigate and/or obviate the afore-described disadvantages.

SUMMARY OF THE INVENTION

The primary objective of the present invention is to provide a positioning structure for a nailer capable of adjusting the position of the nailer arbitrarily. In the rail of magazine is slidably provided an adjusting member whose lateral side is disposed an engaging paw against which a spring abuts. The engaging paw is formed in response to the shape of the cavities in the sidewall of the groove of the rail. On a side of the engaging paw opposite the spring is disposed a press key which partially projects out of the adjusting member so as to be pressed by the user. This adjusting member can enable the user to adjust the position of the nailer arbitrarily.

The secondary objective of the present invention is to provide a positioning structure for a nailer which can make the operation easy for the user and can be prevented from being mistakenly pressed by the user. The lateral disposed engaging paw and the press key can make the operation easy for the user, and the press key is designed to prevent the nailer from being pressed mistakenly by the user.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
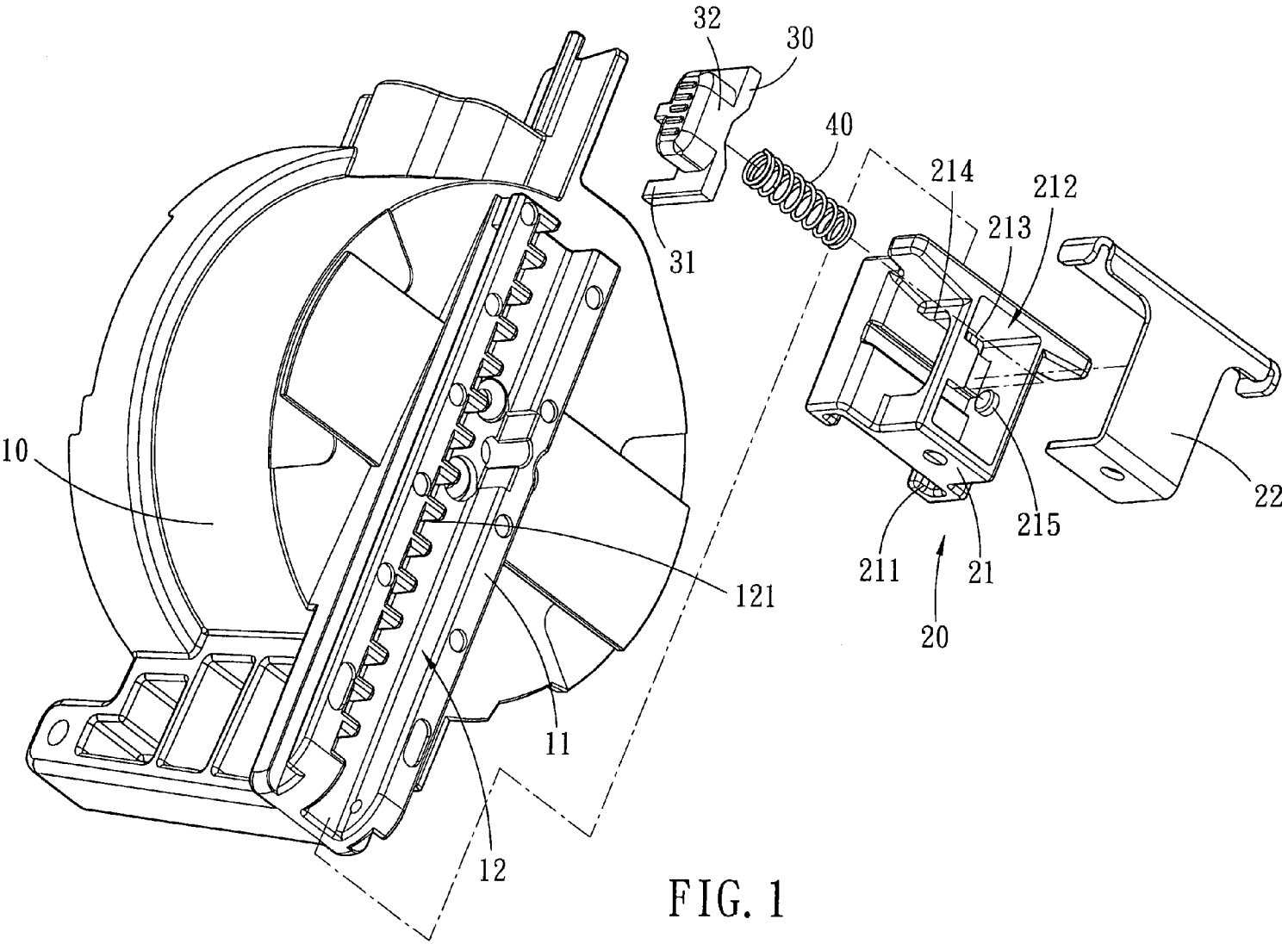
FIG. 1 is an exploded view of a positioning structure for a nailer in accordance with the present invention.
Figure 2:
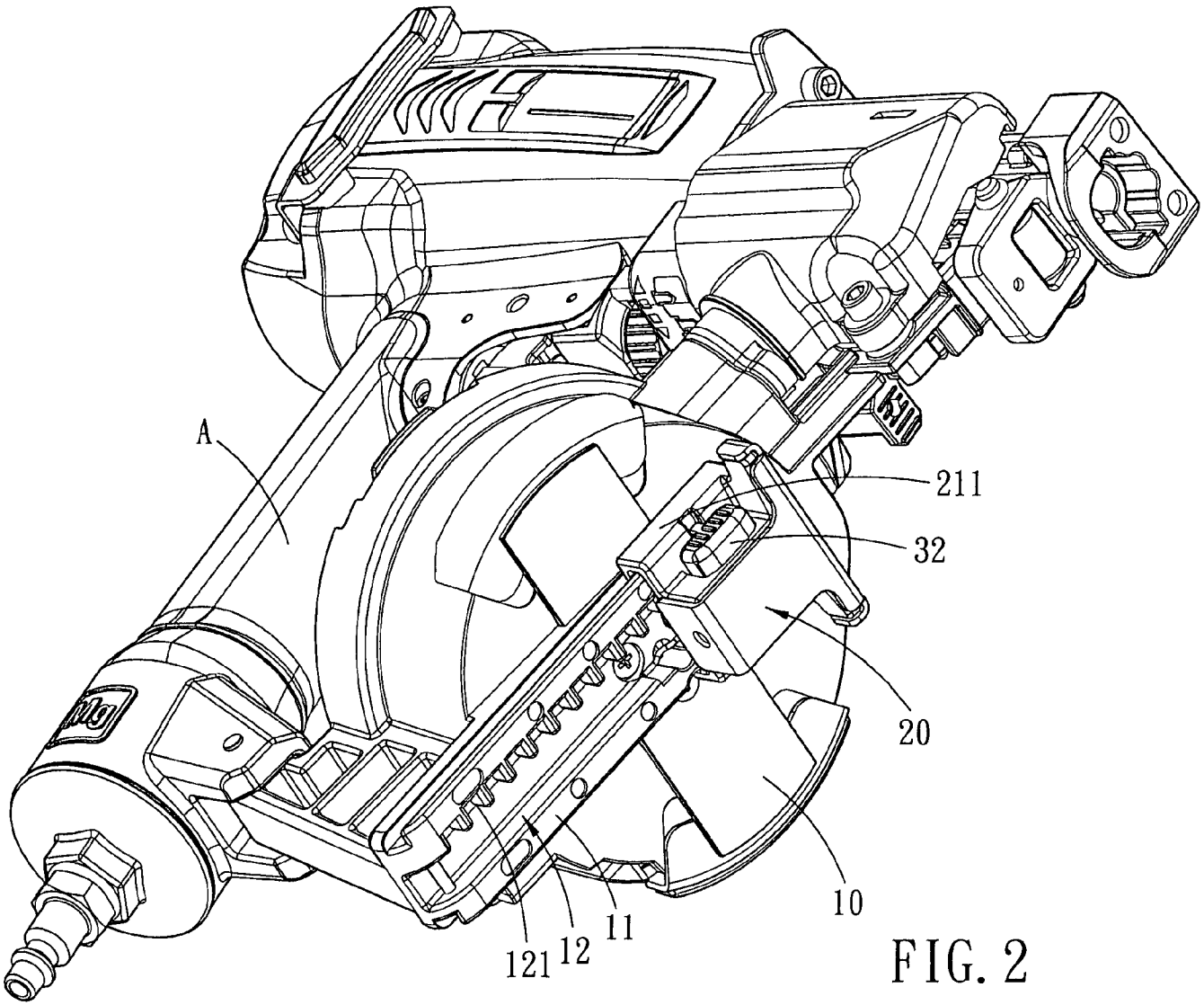
FIG. 2 is an assembly view of the positioning structure for a nailer in accordance with the present invention.
Figure 3:
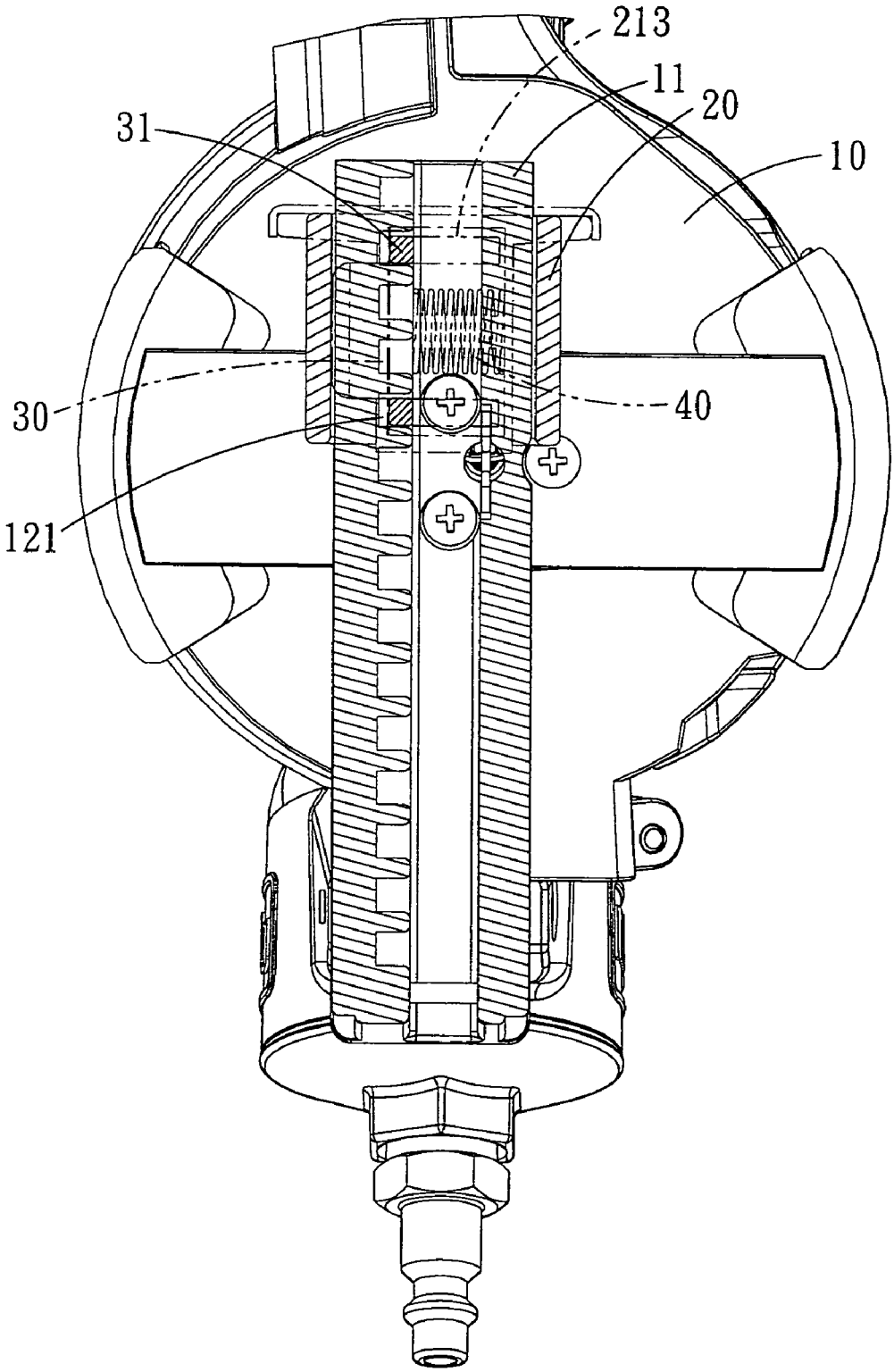
FIG. 3 is a cross sectional view of the positioning structure for a nailer in accordance with the present invention, wherein the positioning structure is fixed.

Referring to FIGS. 1–3, a positioning structure for a nailer in accordance with the present invention generally comprises the following components:

A magazine 10 is installed at the front of the nailer A, in the front side of the magazine 10 is provided a T-shaped rail 11 which is interiorly defined with groove 12. On a sidewall of the groove 12 are arranged a plurality of cavities 121.

An adjusting member 20 comprises a main body 21 and a cover 22. At the bottom surface of the main body 21 are formed two opposite L-shaped flanges which are to be correspondingly mounted onto the T-shaped rail 11 of the magazine 10. The main body 21 is formed with a chamber 212 in which two elongated cavities 213 are formed and located in the direction of the groove 12. In the chamber 212 is further defined a press hole 214 which faces toward the cavities 121 in the groove 12. On a sidewall of the chamber 212 opposite the press hole 214 is formed a positioning block 215.

An engaging paw 30 is slidably disposed in the chamber 212 of the main body 21, at the bottom edge of the engaging paw 30 are provided two positioning projections 31 which are employed to insert in the two elongated cavities 213 of the chamber 212. The two positioning projections 31 are formed in response to the shape of the cavities 121. On a lateral side of the engaging paw 30 is formed a press key 32 which is confined in the chamber 212 and partially protrudes out of the press hole 214. The press key 32 is to be pressed by the user.

A spring 40 is biased between the positioning block 215 of the adjusting block 20 and the engaging paw 30.

With reference to FIG. 3, before the user presses the press key 32, the two positioning projections 31 of the engaging paw 30 is pressed by the spring 40 and engaged in the two elongated cavities 213. Although the two opposite L-shaped flanges 211 of the adjusting member 20 are slidably mounted onto the rail 11, the adjusting member 20 will still be positioned at a desired position by the engaging paw 30. The adjusting member 20 is used to abut against the working surface or the edge of the wall to be nailed, so that the nail can be precisely driven into the object to be operated.

Figure 4:
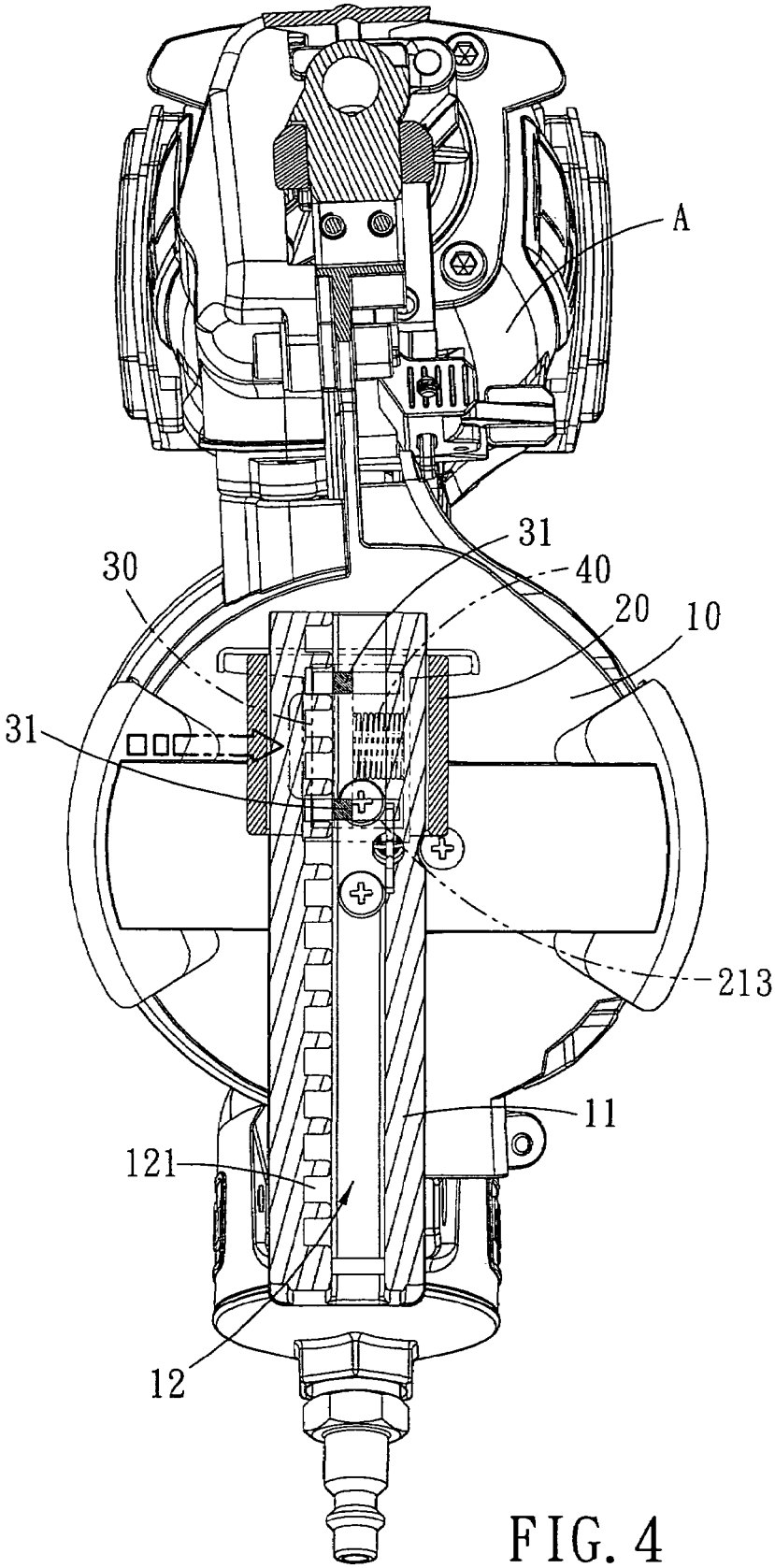
FIG. 4 is a cross sectional view of the positioning structure for a nailer in accordance with the present invention, wherein the positioning structure is being adjusted.

With reference to FIG. 4, when the user keeps pressing down the press key 32, an end of the spring 40 still abuts against the positioning block 215, and another end of the spring 40 is compressed by the engaging paw 30. At this moment, the two positioning projections 31 of the engaging paw 30 are pushed back from the two elongated cavities 213 of the chamber 212 and move into the groove 12 of the magazine 10, that is to say that the two positioning projections 31 of the engaging paw 30 disengage the cavities 121 on the sidewall of the groove 12. The adjusting member 20 is now allowed to move freely along the rail 11 by using the two L-shaped flanges 211, until the user releases the press key 32, the adjusting member 20 will be positioned by the positioning paw 30 again. Through this way, the user can easily position the adjusting member 20 at any position on the rail 10 by using the press key 32.

In addition, since the press key 32 and the positioning paw 30 are disposed at lateral side of the adjusting member 20, this makes the operation easy for the user. Moreover, the press key 32 can be prevented from being pressed by a mistake during operation, since it is laterally disposed.

While we have shown and described various embodiments in accordance with the present invention, it should be clear to those skilled in the art that further embodiments may be made without departing from the scope of the present invention.

What is claimed is:

1. A positioning structure for a nailer comprising:

a magazine installed at a front end of a nailer, the magazine is provided at its front side with a rail in which is defined a groove, and in a sidewall of the groove is formed a plurality of cavities;

an adjusting member slidably mounted on the rail of the magazine, the adjusting member is formed with a chamber, plural elongated cavities are formed in the chamber and located parallel to the groove, in the chamber is further defined a press hole facing toward the cavities in the groove;

an engaging paw slidably disposed in the chamber of the adjusting member, at a bottom edge of the engaging paw is provided a plurality of positioning projections employed to insert in the two elongated cavities of the chamber, the positioning projections are formed in response to the shape of the cavities, on a lateral side of the engaging paw formed a press key which is confined in the chamber and partially protrudes out of the press hole, the press key serves to be pressed by the user;

a spring biased between the positioning block of the adjusting block and the engaging paw.

2. The positioning structure for a nailer as claimed in claim 1, wherein the rail formed on the front side of the magazine is T-shaped in cross section, at the bottom edge of the adjusting member are provided two opposite L-shaped flanges which are slidably mounted on the rail.

3. The positioning structure for a nailer as claimed in claim 1, wherein the adjusting member includes a main body and a cover.

4. The positioning structure for a nailer as claimed in claim 2, wherein the adjusting member includes a main body and a cover.

5. The positioning structure for a nailer as claimed in claim 1, wherein a positioning block is formed on a sidewall of the chamber opposite the press hole, and an end of the spring is positioned on the positioning block.

6. The positioning structure for a nailer as claimed in claim 2, wherein a positioning block is formed on a sidewall of the chamber opposite the press hole, and an end of the spring is positioned on the positioning block.

* * * * *